US010220982B2

(12) United States Patent
Albers

(10) Patent No.: US 10,220,982 B2
(45) Date of Patent: Mar. 5, 2019

(54) FOOD POUCH

(71) Applicant: Luft Industrie, Inc., Oakland, CA (US)

(72) Inventor: Oliver Albers, Oakland, CA (US)

(73) Assignee: LUFT INDUSTRIE INC., Oakland, CA (US)

( * ) Notice: Subject to any disclaimer, the term of this patent is extended or adjusted under 35 U.S.C. 154(b) by 537 days.

(21) Appl. No.: 13/765,279

(22) Filed: Feb. 12, 2013

(65) Prior Publication Data

US 2014/0226921 A1 Aug. 14, 2014

(51) Int. Cl.
*B65D 33/25* (2006.01)

(52) U.S. Cl.
CPC ..... *B65D 33/25* (2013.01); *B65D 2313/00* (2013.01)

(58) Field of Classification Search
CPC ..... B65D 33/24; B65D 33/25
USPC ..... 383/79, 86.1, 86.2, 92, 95, 81, 86, 901
See application file for complete search history.

(56) References Cited

U.S. PATENT DOCUMENTS 1,434,576 A * 11/1922 Wertheimer ..... 126/263.05
2,253,571 A * 8/1941 Miller ..... A61M 3/0266 206/364
2,710,639 A * 6/1955 Farls ..... 383/26
3,376,618 A * 4/1968 Schwarzkopf ..... 24/618
4,121,637 A 10/1978 Jennings
4,166,489 A * 9/1979 Lemelson ..... A44B 15/005 206/38.1
5,647,670 A * 7/1997 Iscovich ..... 383/33
5,692,837 A * 12/1997 Beer ..... 383/210.1
D421,307 S 2/2000 Harmanoglu
6,234,676 B1 5/2001 Galomb et al.
6,575,299 B1 6/2003 Kinigakis
7,001,628 B1 2/2006 Unwin
7,106,202 B2 9/2006 Dickinson
D534,811 S 1/2007 Yashima et al.
7,204,368 B2 4/2007 Cheaure et al.
7,270,479 B2 9/2007 Nelson
7,556,429 B2 7/2009 Taheri
7,665,895 B2 2/2010 Takita et al.
D623,536 S 9/2010 Bohmke
7,824,720 B2 11/2010 Unwin
2007/0031071 A1* 2/2007 Perrette ..... 383/42
2012/0082404 A1* 4/2012 Weir ..... 383/65
2013/0071047 A1* 3/2013 VanLoocke et al. ..... 383/95

* cited by examiner

*Primary Examiner* — Jes F Pascua
(74) *Attorney, Agent, or Firm* — Onello & Mello, LLP.

(57) ABSTRACT

A flexible pouch is provided. The flexible pouch includes a bottom section, vertical walls extending up from the bottom section to form a pouch defining an opening opposite the bottom section, and a closure mechanism including one or more projecting members and one or more receiving members dispersed around upper sections of the vertical walls proximal to the opening. In a closed state, a projecting member and a corresponding receiving member removably couple to at least partially close the opening. The flexible pouch can be used for food storage, for example.

14 Claims, 11 Drawing Sheets

FOOD POUCH

FIELD OF INVENTION

The present invention relates to reusable containers for holding or carrying food, and more particularly to portable, handheld reusable pouches for carrying food.

BACKGROUND

Over the years, many different types of bags, pouches, and wraps have been used for carrying food, such as sandwiches and snacks. Of these, a variety of types have emerged over the years, such as plastic sandwich bags, cellophane, foil and wax paper wraps, and sturdy, reusable containers, e.g., Tupperware® style plastic containers. (Tupperware is a registered trademark of Dart Industries Inc.). There are also some fabric sandwich bags. Of these types, many sandwich bags and plastic containers have closures of various types.

Some plastic sandwich bags have a "zip" style closure, while others have a fold and pocket style closure. Fabric sandwich bags have zip-style closures or Velcro® closures. (Velcro is a registered trademark of Velcro Industries, B.V.) The various types of bags are not sturdy, so the food inside can be damaged, e.g., squished sandwiches or fruit, broken cookies or crackers, and so on. The sturdy plastic containers have a snap-style closure that are generally made to be airtight. These containers are 2-piece, a container and a lid that snaps onto the container. These tend to protect their contents, but they are severally constrained by their rigidity in terms of what they can hold. For example, an apple would not fit in a rigid plastic sandwich containers.

To date, people have adapted to these available options. Many people use wraps, sandwich bags, and rigid plastic containers of various sizes and draw on these different types of containers as needed. In many situations, this may not be ideal, since rigid containers can be bulky and take up a great deal of space in a child's lunchbox, for example. It is not unusual, therefore, to see children's lunchboxes that will not close, because the rigid plastic containers are too bulky. It is also not unusual to see a child's sandwich that was kept in a plastic bag or sandwich wrap deformed by lunchtime—often by a rigid plastic container with which it shared a lunchbox.

SUMMARY OF INVENTION

Silicone pouches in accordance with aspects of the present inventive concepts are unique since they will help to promote reuse and less waste, while still keeping foods fresh with an easy to use open/close system.

In accordance with one aspect of the inventive concepts, provided is a flexible pouch. The flexible pouch can include a bottom section, vertical walls extending up from the bottom section to form a pouch defining an opening opposite the bottom section, and a closure mechanism including one or more projecting members and one or more receiving members dispersed around upper sections of the vertical walls proximal to the opening. In a closed state, a projecting member and a corresponding receiving member removably couple to at least partially close the opening.

In some embodiments, the one or more receiving members comprise one or more holes defined in the upper sections of the vertical walls.

In some embodiments, the one or more projecting members comprise one or more post and stop combinations.

In some embodiments, the stop has a greater width than a corresponding hole and comprises a compressible material that enables compressed passage through the corresponding hole.

In some embodiments, the stop has a greater width than a corresponding hole and portions of upper sections of the vertical walls forming the corresponding hole comprises an expandable material that enables passage of the stop through the corresponding hole.

In some embodiments, the pouch comprises one or more of silocone, rubber and plastic.

In some embodiments, the flexible pouch further includes tabs extending from the upper sections of the vertical walls to facilitate opening of the pouch.

In some embodiments, the closure mechanism further comprises a flap covering the opening opposite the bottom section.

In accordance with another aspect of the inventive concepts, provided is a flexible pouch. The flexible pouch may include a bottom section, vertical walls extending up from the bottom section to form a pouch defining an opening opposite the bottom section, one or more projecting members, wherein the projecting members extend from a first surface at an upper section of the vertical walls proximal to the opening, and one or more receiving members extending through a portion of the pouch opposite the first surface at an upper section of the vertical walls proximal to the opening. In a closed state, a projecting member and a corresponding receiving member removably couple to at least partially close the opening.

In some embodiments, the one or more receiving members comprise one or more holes.

In some embodiments, the one or more projecting members comprise one or more post and stop combinations.

In some embodiments, the stop has a greater width than a corresponding hole and comprises a compressible material that enables compressed passage through the corresponding hole.

In some embodiments, the stop has a greater width than a corresponding hole and portions of upper sections of the vertical walls forming the corresponding hole comprises an expandable material that enables passage of the stop through the corresponding hole.

In some embodiments, the first surface is an inner surface of the pouch.

In some embodiments, the pouch comprises silocone, rubber or plastic.

In some embodiments, the flexible pouch further includes tabs extending from upper sections of the vertical walls to facilitate opening of the pouch.

In some embodiments, the closure mechanism further comprises a flap covering the opening opposite the bottom section.

In accordance with another aspect of the inventive concepts, provided is a flexible pouch. The flexible pouch may include a bottom section, vertical walls extending up from the bottom section to form a pouch defining an opening opposite the bottom section, and a closure mechanism including one or more projecting members and one or more receiving members dispersed around upper sections of the vertical walls proximal to the opening. In a closed state, a projecting member and a corresponding receiving member removably couple to at least partially close the opening. The one or more receiving members comprise one or more holes defined in the upper sections of the vertical walls, the one or more projecting members comprise one or more post and stop combinations, and the pouch comprises one or more of silocone, rubber and plastic.

In some embodiments, the flexible pouch further includes tabs extending from the upper sections of the vertical walls to facilitate opening of the pouch.

In some embodiments, the closure mechanism further comprises a flap covering the opening opposite the bottom section.

DESCRIPTION OF DRAWINGS

The present invention will become more apparent in view of the attached drawings and accompanying detailed description. The embodiments depicted therein are provided by way of example, not by way of limitation, wherein like reference numerals refer to the same or similar elements. The drawings are not necessarily to scale, emphasis instead being placed upon illustrating aspects of the invention. In the drawings.

DETAILED DESCRIPTION OF PREFERRED EMBODIMENTS

Various exemplary embodiments will be described more fully hereinafter with reference to the accompanying drawings, in which some exemplary embodiments are shown. The present inventive concept may, however, be embodied in many different forms and should not be construed as limited to the exemplary embodiments set forth herein.

It will be understood that, although the terms first, second, etc. are be used herein to describe various elements, these elements should not be limited by these terms. These terms are used to distinguish one element from another, but not to imply a required sequence of elements. For example, a first element can be termed a second element, and, similarly, a second element can be termed a first element, without departing from the scope of the present invention. As used herein, the term "and/or" includes any and all combinations of one or more of the associated listed items.

It will be understood that when an element is referred to as being "on" or "connected" or "coupled" to another element, it can be directly on or connected or coupled to the other element or intervening elements can be present. In contrast, when an element is referred to as being "directly on" or "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, steps, operations, elements, and/or components, but do not preclude the presence or addition of one or more other features, steps, operations, elements, components, and/or groups thereof.

Spatially relative terms, such as "beneath," "below," "lower," "above," "upper" and the like may be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as "below" and/or "beneath" other elements or features would then be oriented "above" the other elements or features. The device may be otherwise oriented (e.g., rotated 90 degrees or at other orientations) and the spatially relative descriptors used herein interpreted accordingly.

Figure 1:
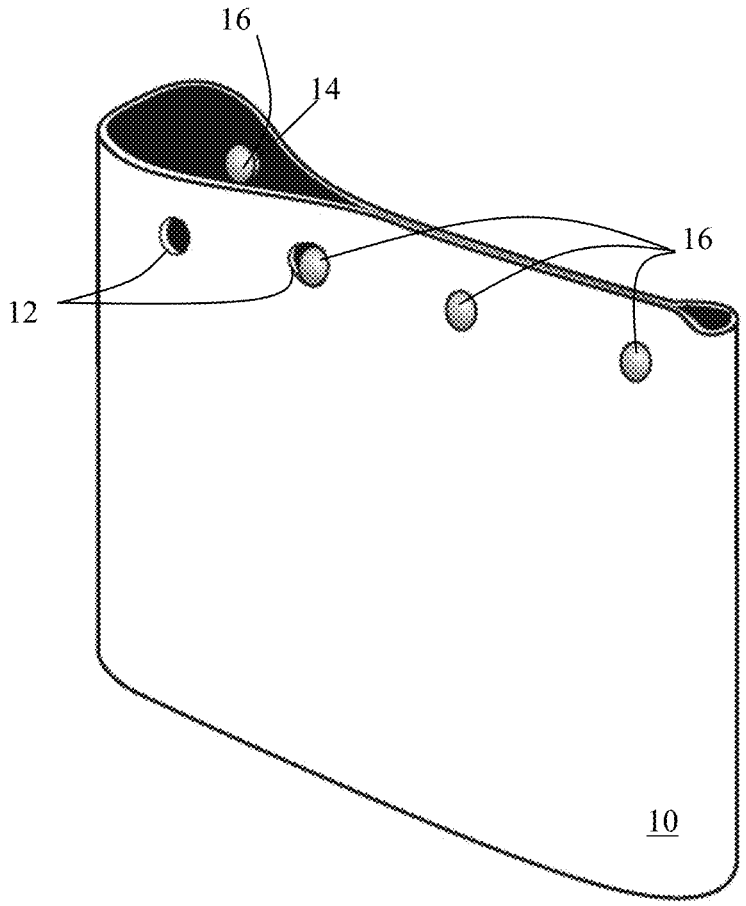
FIG. 1 is a perspective view of a first embodiment of a food pouch in a partially opened state, in accordance with the present inventive concepts.
Figure 2A:
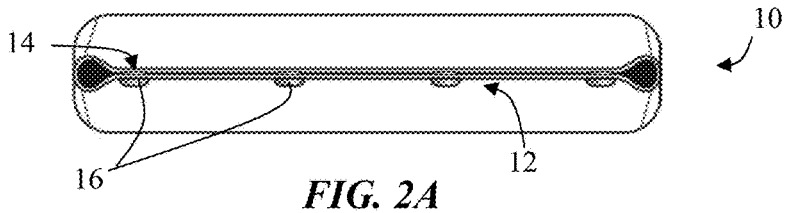
FIG. 2A is a top view of the first embodiment of the food pouch of FIG. 1 in a closed state.
Figure 2B:
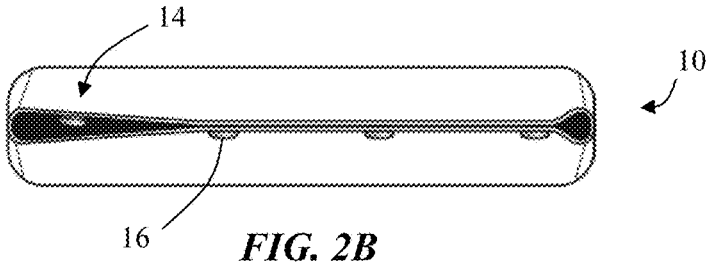
FIGS. 2B-2D are top views of the first embodiment of the food pouch of FIG. 1 in a partially opened state.
Figure 2C:
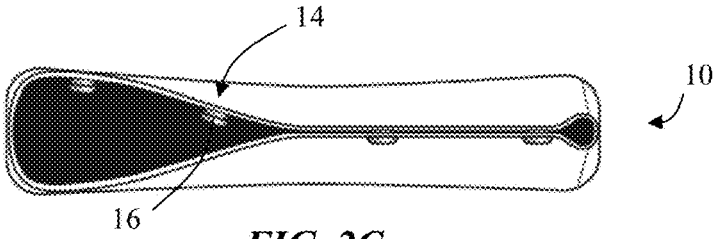
Figure 2D:
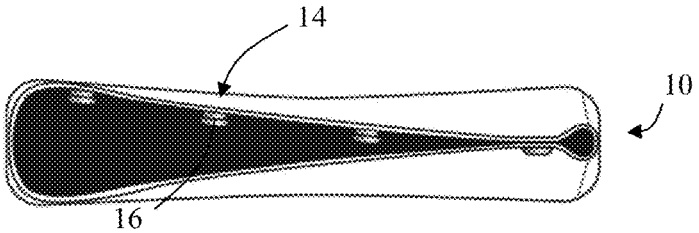
Figure 2E:
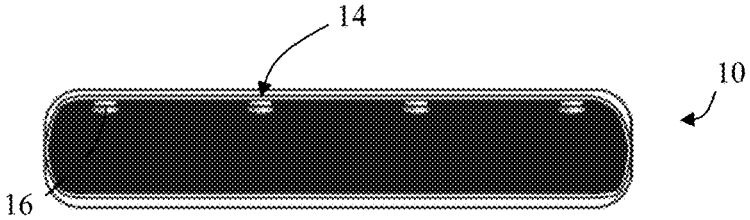
FIG. 2E is a top view of the first embodiment of the food pouch of FIG. 1 in an opened state.
Figure 3A:
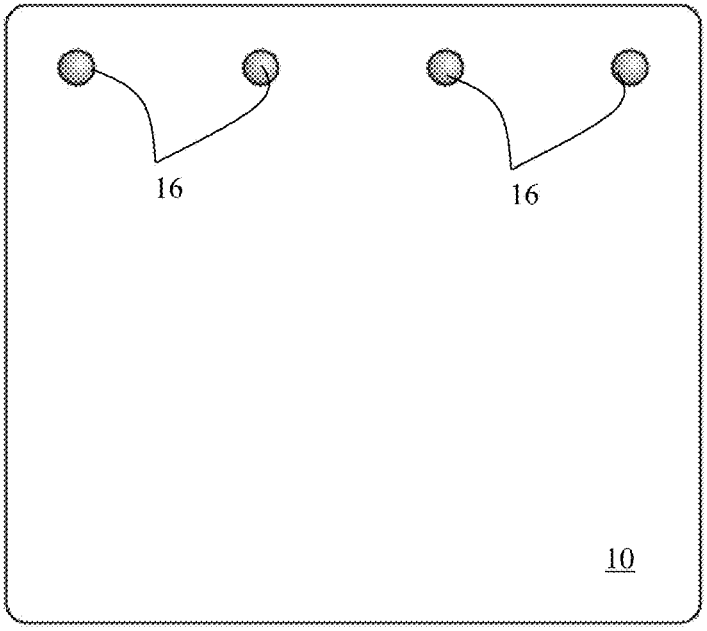
FIG. 3A is a front view of the first embodiment of the food pouch of FIG. 1 in a closed state.
Figure 3B:
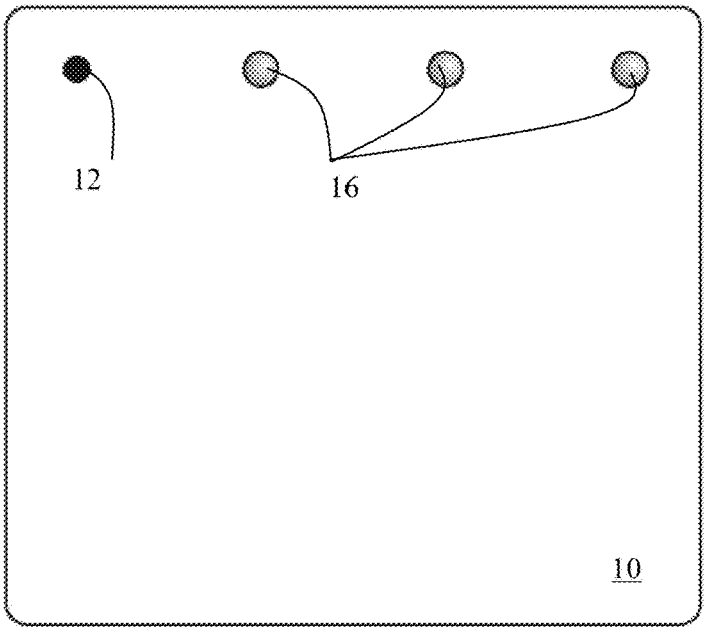
FIGS. 3B-3D are front views of the first embodiment of the food pouch of FIG. 1 in a partially opened state.
Figure 3C:
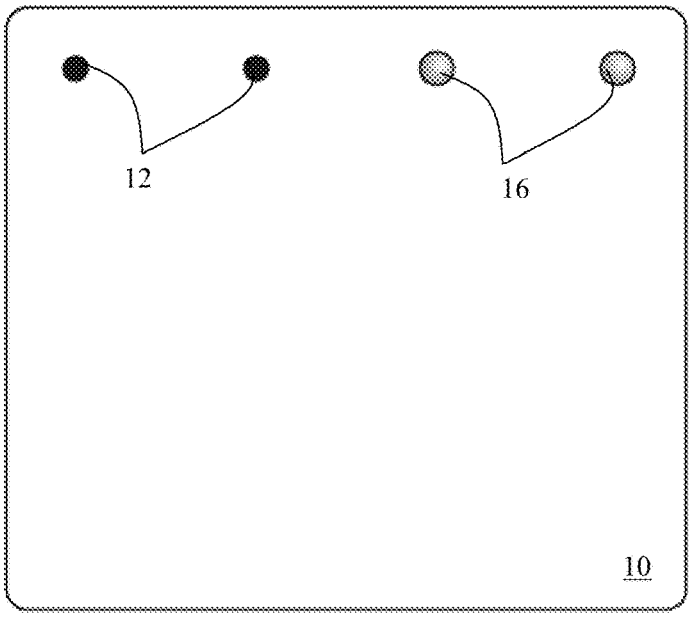
Figure 3D:
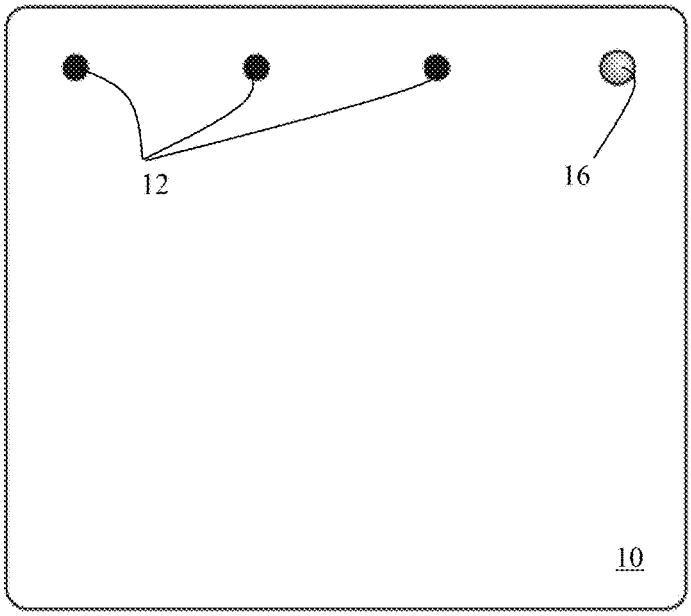
Figure 3E:
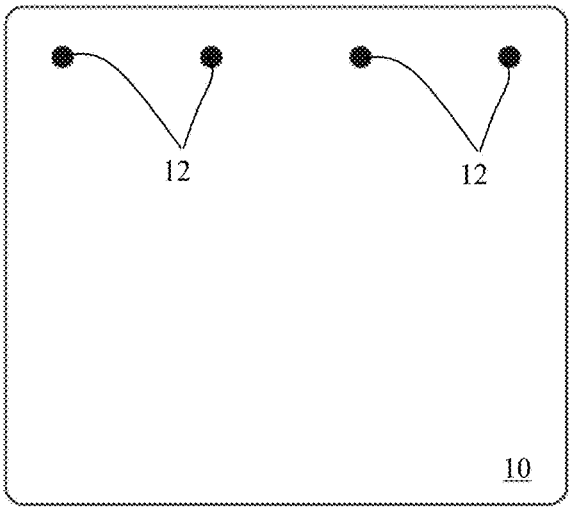
FIG. 3E is a front view of the first embodiment of the food pouch of FIG. 1 in an opened state.
Figure 4:
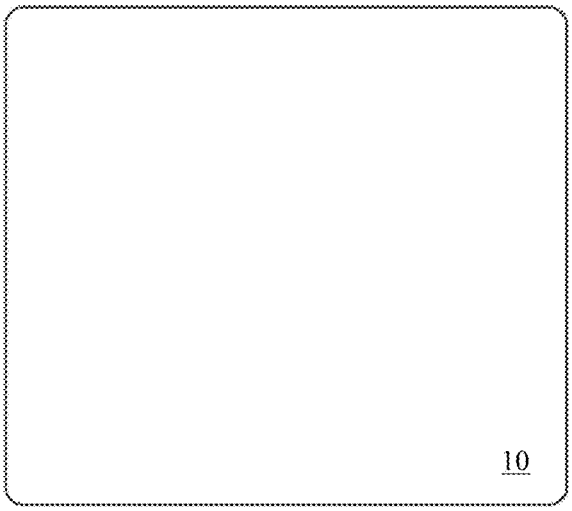
FIG. 4 is a rear view of the first embodiment of the food pouch of FIG. 1.
Figure 5:
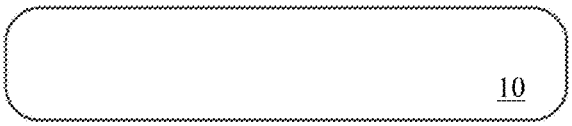
FIG. 5 is a bottom view of the first embodiment of the food pouch of FIG. 1.
Figure 6:
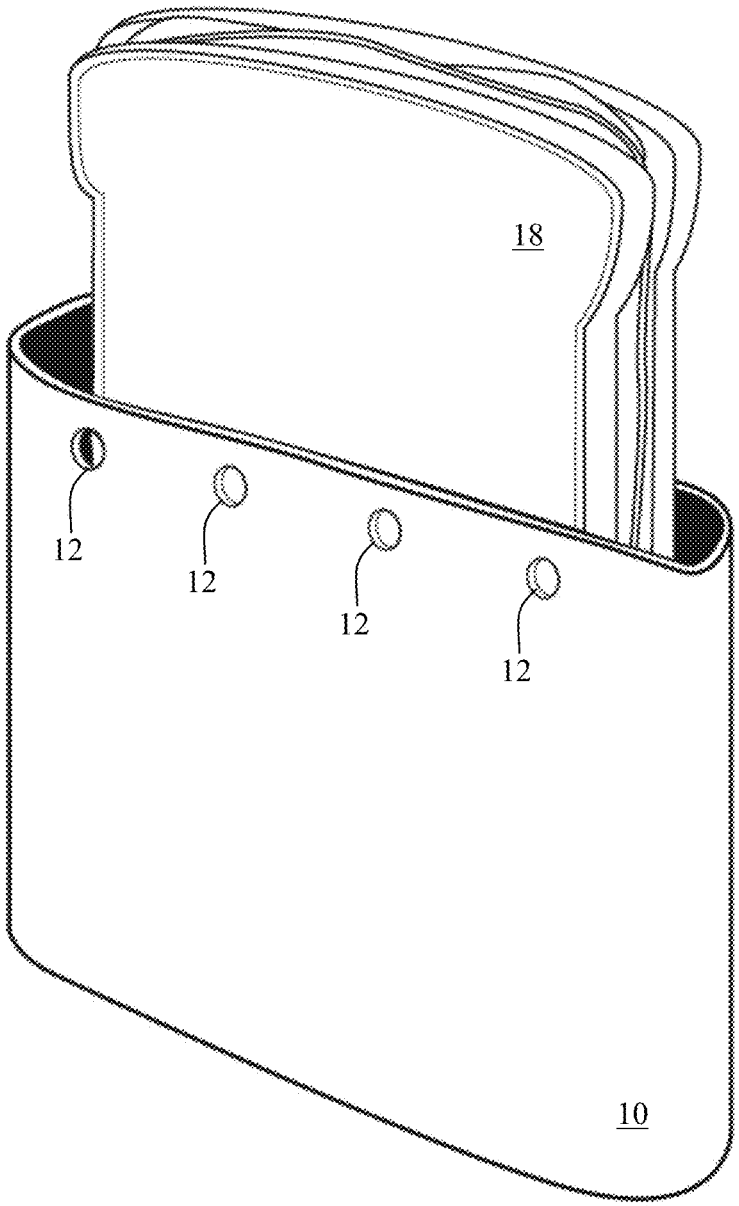
FIG. 6 is a perspective view of the first embodiment of the food pouch of FIG. 1 with food therein.

The food pouches described herein are portable, handheld reusable pouches for carrying food. The food pouches protect the food and keep the food fresh. The food pouches help to promote reuse and less waste, while still keeping foods fresh with an easy to use open/close system FIG. 1 is a perspective view of a first embodiment of a food pouch 10 in a partially opened state, in accordance with the present inventive concepts. FIG. 2A is a top view of the first embodiment of the food pouch 10 of FIG. 1 in a closed state, FIGS. 2B-2D are top views of the first embodiment of the food pouch 10 of FIG. 1 in a partially opened state, and FIG. 2E is a top view of the first embodiment of the food pouch 10 of FIG. 1 in an opened state. FIG. 3A is a front view of the first embodiment of the food pouch 10 of FIG. 1 in a closed state, FIGS. 3B-3D are front views of the first embodiment of the food pouch 10 of FIG. 1 in a partially opened state, and FIG. 3E is a front view of the first embodiment of the food pouch 10 of FIG. 1 in an opened state. FIG. 4 is a rear view of the first embodiment of the food pouch 10 of FIG. 1. FIG. 5 is a bottom view of the first embodiment of the food pouch 10 of FIG. 1. FIG. 6 is a perspective view of the first embodiment of the food pouch 10 of FIG. 1 with food therein.

The food pouch 10 may comprise any flexible material. The flexible material may be, for example, silocone, rubber or plastic. Other examples could also be found, the foregoing not being an exhaustive list. The food pouch 10 material may have a thickness of approximately 1.5 mm. However, the food pouch 10 material may be thinner or thicker than 1.5 mm in other embodiments. The flexible material comprises a material and thickness that protects the contents of the food pouch 10, but remains flexible such that the food pouch 10 is not rigid.

In preferred embodiments, the construction and materials used enable the food pouch 10 to be reused. That is, the food pouch 10 is not disposed of after use. The food pouch 10 is easy to clean. The flexible material may be easily rinsed and/or whipped. In some embodiments, the food pouch 10 may be dishwasher and microwave safe.

The food pouch 10 may be of a sufficient size to store a main meal or single serving food item, for example, a sandwich, a wrap, a bagel, or one or more slices of pizza, for example, as illustrated in FIG. 6. Other examples of foods could also be found, the foregoing not being an exhaustive list. In another embodiment, the food pouch 10 may be of a smaller size to store smaller foods, for example, snacks, fruit or vegetables. Other examples of foods could also be found, the foregoing not being an exhaustive list. The size of the food pouch 10 is not limited thereto; other sizes may be used.

The food pouch 10 may have a closure mechanism which is easy to use. The closure mechanism may be easily manipulated by both children and adults.

The closure mechanism may include one or more projecting members and one or more receiving members dispersed around upper sections of vertical walls proximal to an opening of the food pouch 10. In a mated state a projecting member and a corresponding receiving member removably couple to at least partially close the opening.

Referring to the first embodiment, as illustrated in FIGS. 1-6, the one or more receiving members comprise one or more holes 12 defined in the upper sections of the vertical walls of the food pouch 10. In the illustrative embodiment, the food pouch 10 is illustrated as comprising four holes 12; however, the food pouch 10 is not limited thereto. The food pouch 10 may include more or less than four holes 12. The holes 12 are illustrated having a round or circular shape; however, the shape of the holes 12 is not limited thereto.

Figure 10:
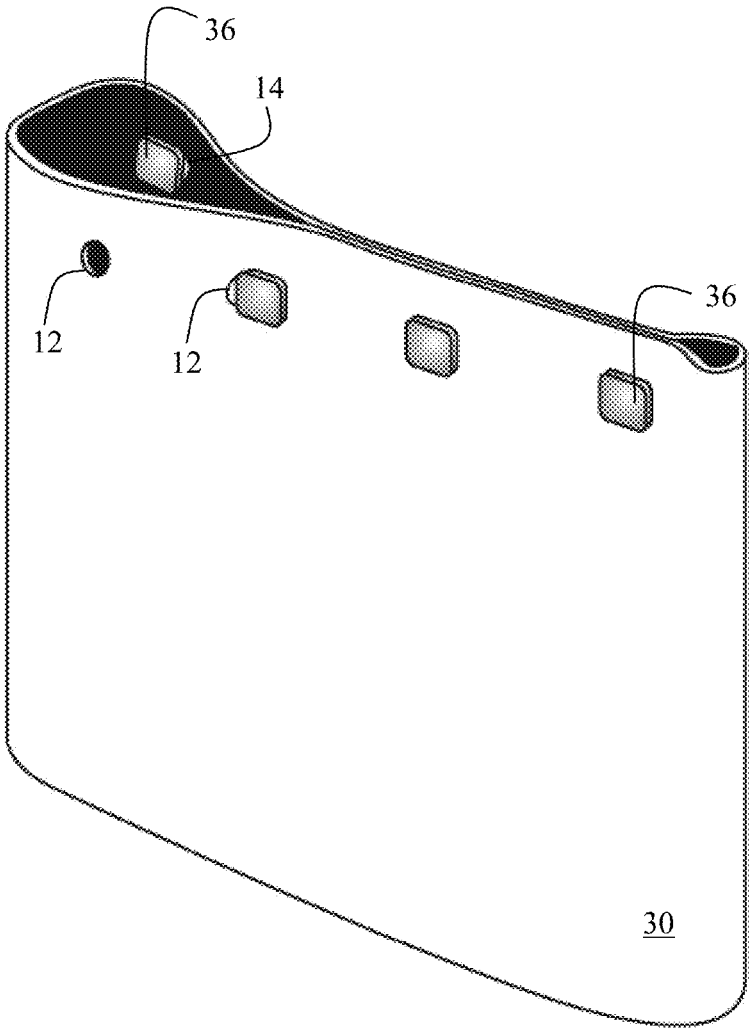
FIG. 10 is a perspective view of a third embodiment of a food pouch in a partially opened state, in accordance with the inventive concepts.

The food pouch 10 is illustrated as comprising four post 14 and stop 16 combinations; however, the food pouch 10 is not limited thereto. The food pouch 10 may include more or less than four post 14 and stop 16 combinations. The posts 14 are illustrated having a cylindrical shape; however, the shape of the posts 14 is not limited thereto. The stops 16 are illustrated having a round or circular shape; however, the shape of the stops 16 is not limited thereto. For example, FIG. 10 is a perspective view of another embodiment of a food pouch 30 in a partially opened state, in accordance with the inventive concepts. The food pouch 30 is similar to the food pouch 10 of FIG. 1, except the food pouch 30 comprises stops 36 having a square shape in this embodiment. In other embodiments, the stops may be in the shape of a flower, truck, or other design. Other examples could also be found, the foregoing not being an exhaustive list.

The one or more projecting members may comprise one or more post 14 and stop 16 combinations. The stop 16 is wider in diameter than at least a portion of the post 14 passing through hole 12. The stop 16 has a greater width than a corresponding hole 12. The stop 16 may be compressible, for example, comprise a compressible material, to enable compressed passage through the corresponding hole 12. Additionally or alternatively, portions of upper sections of the vertical walls of the food pouch 10 forming the corresponding hole 12 may comprise an expandable material that enables passage of the stop 16 through the corresponding hole 12. In this latter embodiment, the stop 16 need not be compressible.

As illustrated in FIGS. 1-2E, the projecting members including posts 14 and stops 16 extend from an inner surface of the food pouch 10. The holes 12 are disposed through a surface of the food pouch opposite the inner surface of the food pouch 10 having the projecting members.

The holes 12 can comprise an expandable material, as illustrated in FIG. 1. In such a case, when the stops 16 are pushed through the corresponding holes 12, the holes 12 may be stretched to accommodate stops 16, which have a greater width than the corresponding holes 12. The holes 12 then return to an un-stretched state, preventing the stops 16 from sliding through the holes 12 and maintaining the food pouch 10 in a closed state. When opening the food pouch 10, opposite sides of the pouch are pulled apart such that the stops 16 are pulled through the corresponding holes 12. As the stops 16 are pulled through the corresponding holes 12, the corresponding holes 12 may stretch to allow passage of the stops 16 therethrough.

As illustrated in FIG. 6, food, for example, a sandwich, 18 can be inserted into the food pouch 10. Then, the food pouch 10 can be closed by pushing each stop 16 through a corresponding hole 12, as illustrated in FIGS. 1, 2A-2E and 3A-3E.

Figure 7:
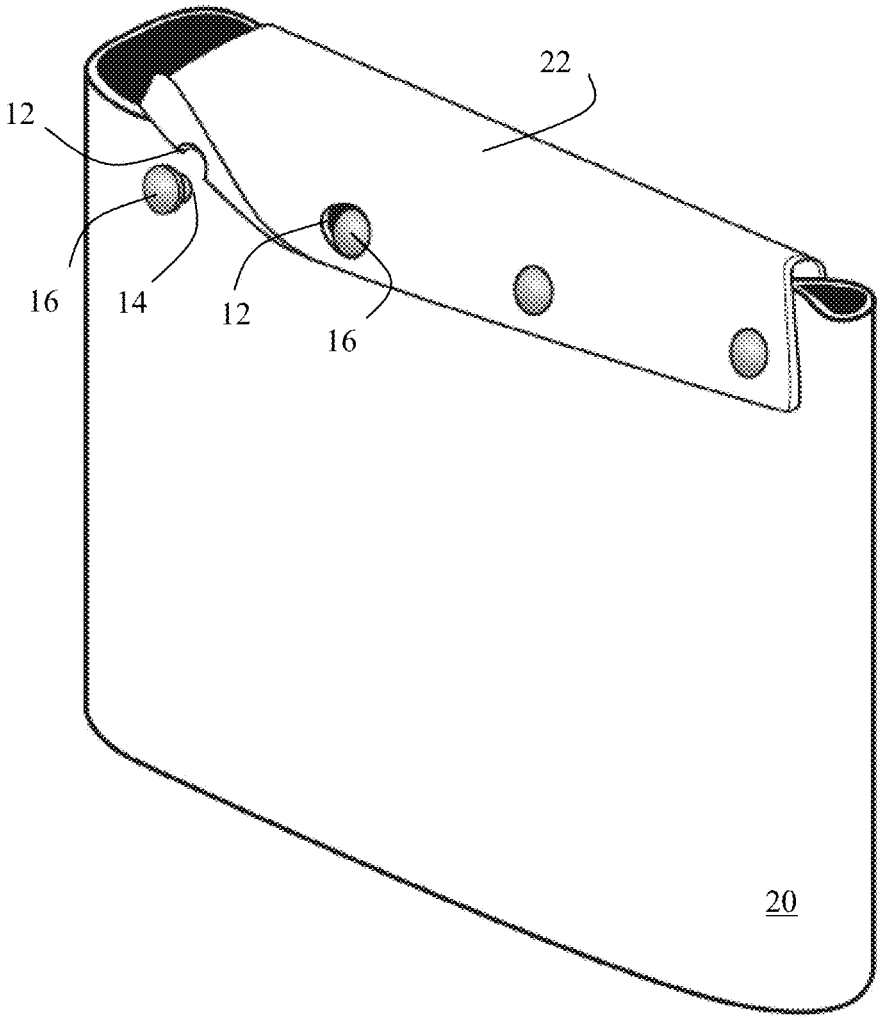
FIG. 7 is a perspective view of a second embodiment of a food pouch in a partially opened state, in accordance with the inventive concepts.
Figure 8:
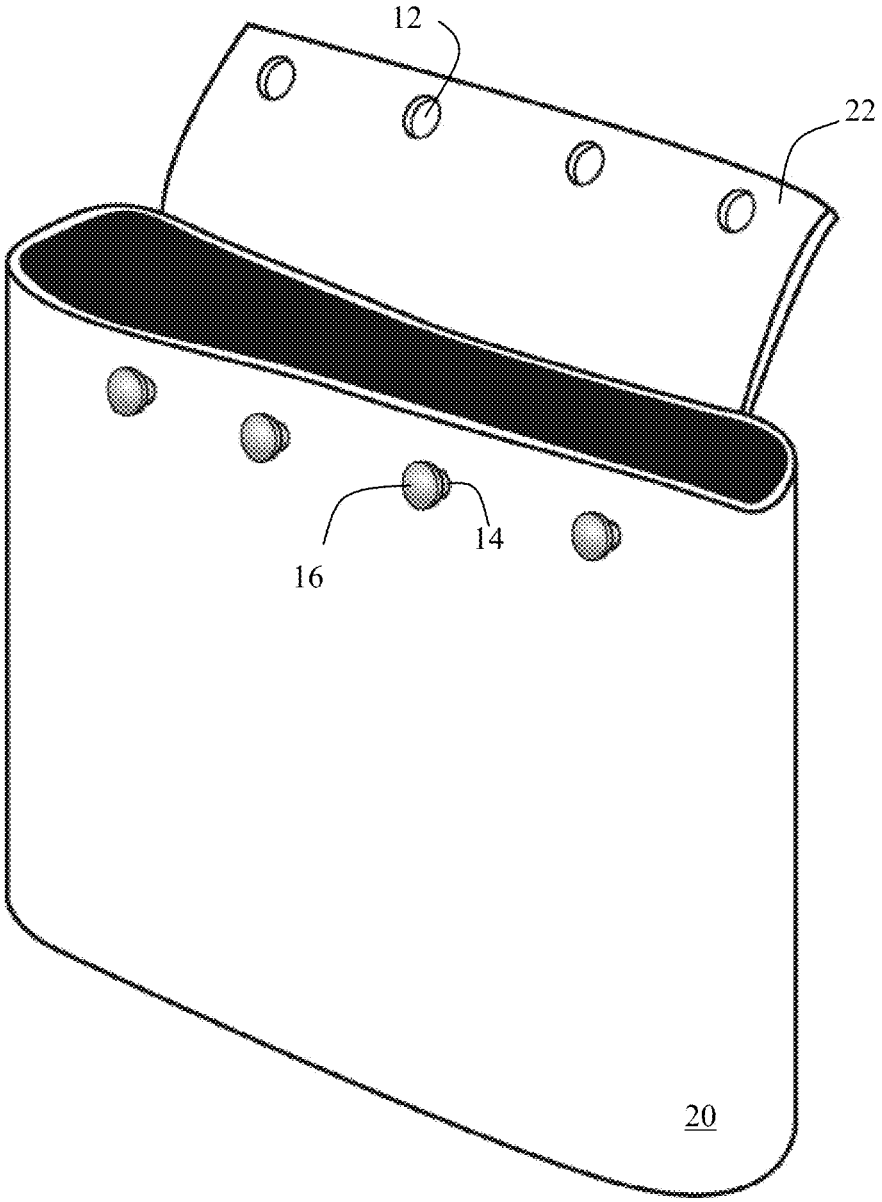
FIG. 8 is a perspective view of the second embodiment of the food pouch of FIG. 7 in an opened state.
Figure 9:
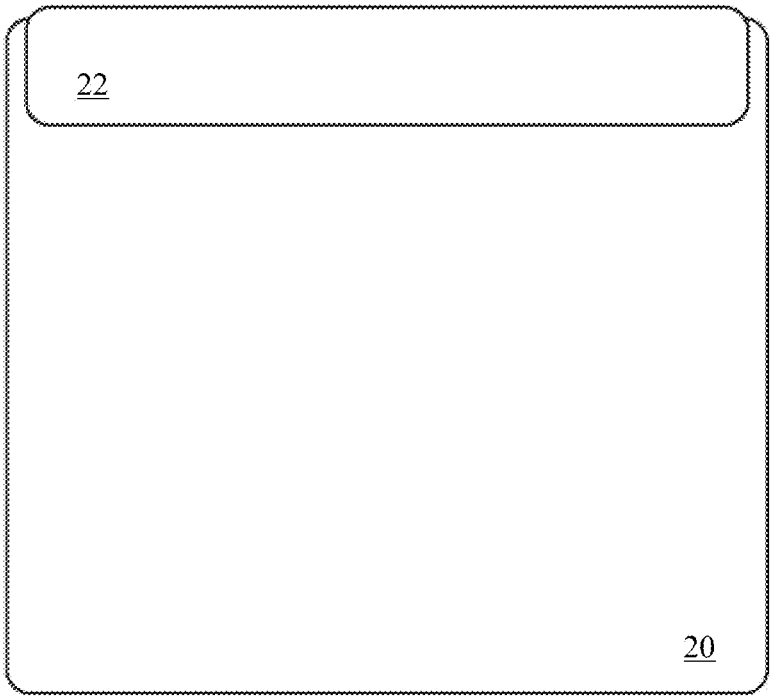
FIG. 9 is a rear view of the second embodiment of the food pouch of FIG. 7.

FIG. 7 is a perspective view of a second embodiment of a food pouch 20 in a partially opened state, in accordance with the inventive concepts. FIG. 8 is a perspective view of the second embodiment of the food pouch 20 of FIG. 7 in an opened state. FIG. 9 is a rear view of the second embodiment of the food pouch 20 of FIG. 7.

In this embodiment, the food pouch 20 is similar to the food pouch 10 of FIG. 1 except the food pouch 20 includes a flap 22. In this embodiment, the projecting members including posts 14 and stops 16 are disposed at an outer surface of the food pouch 20. The corresponding holes 12 are formed in the flap 22. In a closed state, the flap 22 extends over a top portion of the food pouch 20 covering the opening in the upper portion of the food pouch 20. The flap 22 provides further protection of the contents of the food pouch 20.

When closing the food pouch 20, the flap 22 is pulled over the opening in the top of the food pouch 20 and each stop 16 is pushed through a corresponding hole 12 on the flap 22. When the stops 16 are pushed through the corresponding holes 12, the holes 12 may be stretched around stops 16 which have a greater width than the corresponding holes 12. The holes 12 then return to an un-stretched state, preventing the stops 16 from sliding through the holes 12 and maintaining the food pouch 10 in a closed state. When opening the food pouch 20, the corner of the flap 22 is pulled back such that the stops 16 are pulled through the corresponding holes 12. As the stops 16 are pulled through the corresponding holes 12, the corresponding holes 12 are stretched to allow passage of the stops 16 therethrough.

Figure 11:
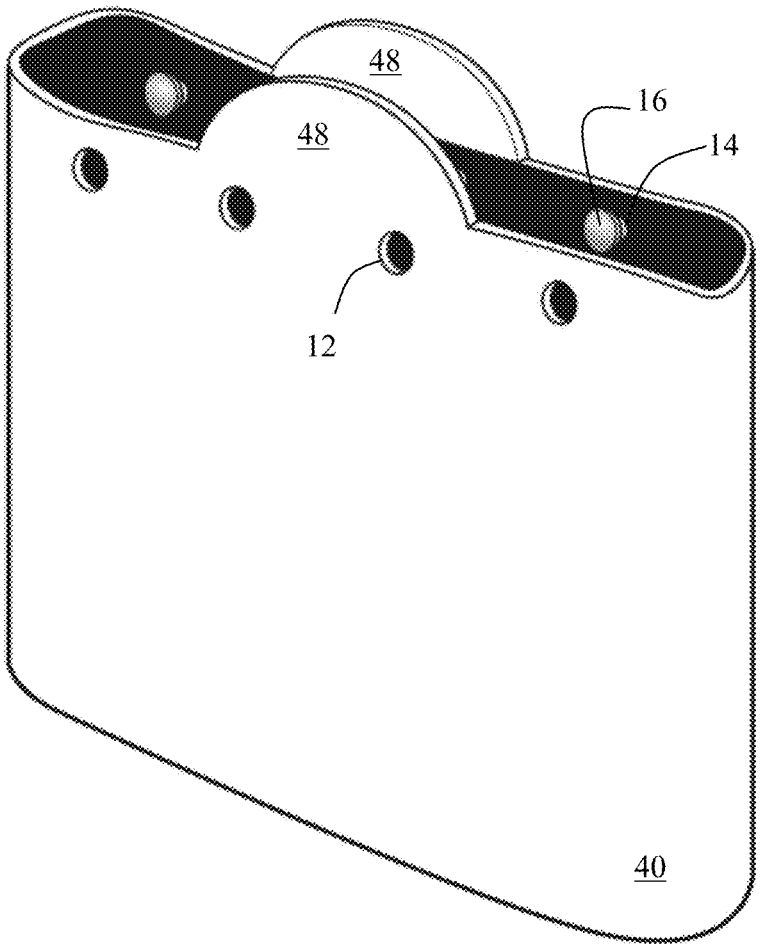
FIG. 11 is a perspective view of a fourth embodiment of a food pouch in an opened state, in accordance with the inventive concepts.

FIG. 11 is a perspective view of another embodiment of a food pouch 40 in an opened state, in accordance with the inventive concepts. The food pouch 40 is similar to the food pouch 10 of FIGS. 1-6, except the food pouch 40 includes tabs 48. The tabs 48 are formed at upper surfaces of the food pouch 40 proximal to an opening of the food pouch 40. A first tab 48 is disposed on the side of the food pouch 40 having the holes 12 and a second tab 48 is disposed on the side of the food pouch 40 having the posts 14 and stops 16 extending therefrom which is opposite to the side having the first tab 48. The tabs 48 are configured to be gripped and pulled apart from each other when opening the food pouch 40. The tabs 48 facilitate opening of the pouch by making it easier to pull the stops 16 through corresponding holes 12. The tabs 48 may include posts or bumps which aid in gripping the tabs 48.

While the foregoing has described what are considered to be the best mode and/or other preferred embodiments, it is understood that various modifications can be made therein and that the invention or inventions may be implemented in various forms and embodiments, and that they may be applied in numerous applications, only some of which have been described herein. It is intended by the following claims to claim that which is literally described and all equivalents thereto, including all modifications and variations that fall within the scope of each claim.

What is claimed is:

1. A flexible pouch, comprising:

a closed bottom section;

vertical walls extending up from the bottom section to form an internal storage volume having an opening opposite the bottom section; and a closure mechanism including a plurality of projecting members and a plurality of receiving members dispersed around upper sections of the vertical walls proximal to and below the opening, wherein, in a closed state, the projecting members and the receiving members removably couple to at least partially close the opening, and wherein:

the receiving members comprise stretchable holes formed in the upper sections of the vertical walls, and the projecting members comprise post and stop combinations extending directly from an inner surface of the vertical walls, wherein the stop has a greater width than a corresponding receiving member stretchable hole and comprises a compressible material that enables compressed passage through the corresponding receiving member stretchable hole.

2. The flexible pouch of claim 1, wherein the pouch is formed of a single piece of reusable material that comprises one or more of silicone, rubber and plastic.

3. The flexible pouch of claim 2, wherein the closure mechanism, including the projecting members and the receiving members, form part of the single piece of reusable material.

4. The flexible pouch of claim 1 further comprising at least two tabs extending from the upper sections of front and rear walls from the vertical walls to facilitate opening of the pouch.

5. The flexible pouch of claim 1, including at least four projecting members and at least four corresponding receiving members.

6. The flexible pouch of claim 1, wherein the flexible pouch is dishwasher and microwave safe.

7. A flexible food storage pouch, comprising:

a closed bottom section;

vertical walls extending up from the bottom section to form an internal storage volume having an opening opposite the bottom section;

a plurality of projecting members distributed along and extending directly from an inner surface of an upper section of the vertical walls proximal to and below the opening, each of the projecting members comprising a compressible stop; and a plurality of receiving members comprising stretchable holes distributed along and formed in the upper section of the vertical walls opposite the projecting members and arranged to receive and engage the compressible stops, wherein:

in a closed state, the projecting members and the corresponding receiving members removably couple to at least partially close the opening, and the flexible pouch is formed of a single piece of reusable material that is stretchable and compressible.

8. The flexible pouch of claim 7, wherein the plurality of projecting members comprises a plurality of post and stop combinations.

9. The flexible pouch of claim 7, wherein each stop has a greater width than its corresponding stretchable hole.

10. The flexible pouch of claim 7, wherein the single piece of material comprises at least one of silicone, rubber, or plastic.

11. The flexible pouch of claim 7 further comprising tabs extending from upper sections of the vertical walls to facilitate opening of the pouch.

12. The flexible pouch of claim 7, wherein the pouch, projecting members, and receiving members form part of the single piece of reusable material.

13. The flexible pouch of claim 7, including at least four projecting members and at least four corresponding receiving members.

14. The flexible pouch of claim 7, wherein the flexible pouch is dishwasher and microwave safe.

* * * * *